United States Patent [19]

Kelly

[11] 4,382,353

[45] May 10, 1983

[54] REVERSE FURRING TECHNIQUE

[76] Inventor: Thomas L. Kelly, 31 Sands St., Waterbury, Conn. 06723

[21] Appl. No.: 162,418

[22] Filed: Jun. 24, 1980

[51] Int. Cl.[3] ..... E04D 1/28; E04D 1/36

[52] U.S. Cl. ..... 52/506; 52/417; 52/309.5; 52/404

[58] Field of Search ..... 52/506, 509, 417, 416, 52/309.5, 309.8, 404, 410

[56] References Cited

U.S. PATENT DOCUMENTS

| | | | |
|---|---|---|---|
| 1,642,282 | 9/1927 | Weiss | 52/417 |
| 2,045,311 | 6/1936 | Roos et al. | 52/506 |
| 4,063,395 | 12/1977 | Stewart et al. | 52/509 X |

*Primary Examiner*—J. Karl Bell

*Attorney, Agent, or Firm*—Hayes & Reinsmith

[57] ABSTRACT

A roofing construction wherein a plurality of blocks of insulation are loosely laid on a roof deck in abutting relation. So-called "flat roofs" are conventionally provided with an inclination to the horizontal so that water will naturally flow from the roof. The aforesaid insulation blocks are preferably of oblong shape and are laid longitudinally with respect to the direction of the natural water flow on the roof so that the longitudinal abutting edges of the insulation blocks produce a seam which is parallel to the natural flow of the water from the roof, and the inclination thereof. A furring strip of either wood or metal is applied over each longitudinal seam between adjacent blocks and this strip is secured firmly by means of screws or other fastening devices which extend through the strip and into the roof deck so that in effect the adjacent insulation blocks are clamped between the furring strip and the metal roof deck. Where rubber roofing is used the rubber membrane is caused to adhere to the furring strips by any suitable adhesive so that it is unnecessary to apply the adhesive over the entire rubber membrane to cause its sound adherence to the top surface of the roofing structure.

1 Claim, 2 Drawing Figures

REVERSE FURRING TECHNIQUE

BRIEF SUMMARY OF THE INVENTION

It is conventional in the construction of flat roofs to provide a slight inclination to the horizontal in the roof deck structure upon which the remaining elements of the roof are securely mounted. It will be clear that such inclination is provided so that there will be a natural flow of water from the roof to avoid stagnant or the like pools of water upon the roof. It is highly desirable that the elements which are mounted on and secured to the roof deck structure having the aforementioned inclination, provide no obstacles to the natural flow of water from the roof. If such obstacles appeared in the roof of this general character, it will be apparent that the natural flow of water from the roof would be hindered or completely obstructed. In order to overcome these and other difficulties I have provided a roof which is so laid that no obstacles to the natural flow of water will be present. The elements which are mounted on and secured to the basic roof structure comprise a plurality of blocks of insulation which are preferably, though not necessarily, of oblong shape and these are laid in abutting relationship providing longitudinal seams between adjacent blocks in a series of blocks and it is significant that the blocks are so laid that these seams are parallel to the natural flow of water from the roof. Furring strips are employed which overlay the seams and a portion of adjacent blocks and screws or other fastening means are provided for securing the strips to the roof deck, the screws passing through the strips, the insulation and the roof deck. Thus, as this description proceeds it will be apparent that the blocks of insulation are clamped between the furring strips and the roof deck. A rubber or the like membrane covers the insulation blocks, the strips and the heads of the screws, and such membrane is adhesively secured to each furring strip which extends over the seams.

Additional objects and advantages of the present invention will become more readily apparent to those skilled in the art when the following general statements and descriptions are read in the light of the appended drawings.

DETAILED DESCRIPTION

In the accompanying drawings a part of a roof structure is disclosed which embodies the structural concept of this invention. So-called "flat roofs" are constructed with a slight inclination to the horizontal so that there will be a natural flow of water from the roof. It is one of the significant purposes of this invention to so construct a roofing structure that it will not in any way hinder, obstruct or adversely affect the natural flow of water from the roof. A roof of this character comprises generally a roof deck which is mounted on joists and the roof deck is conventionally formed of a metallic material and in the so-called flat roof construction the roof deck and the joists are so constructed that the elements of the roof which are mounted on and fastened to the roof deck will have the slight inclination to the horizontal imparted thereto.

Figure 1:
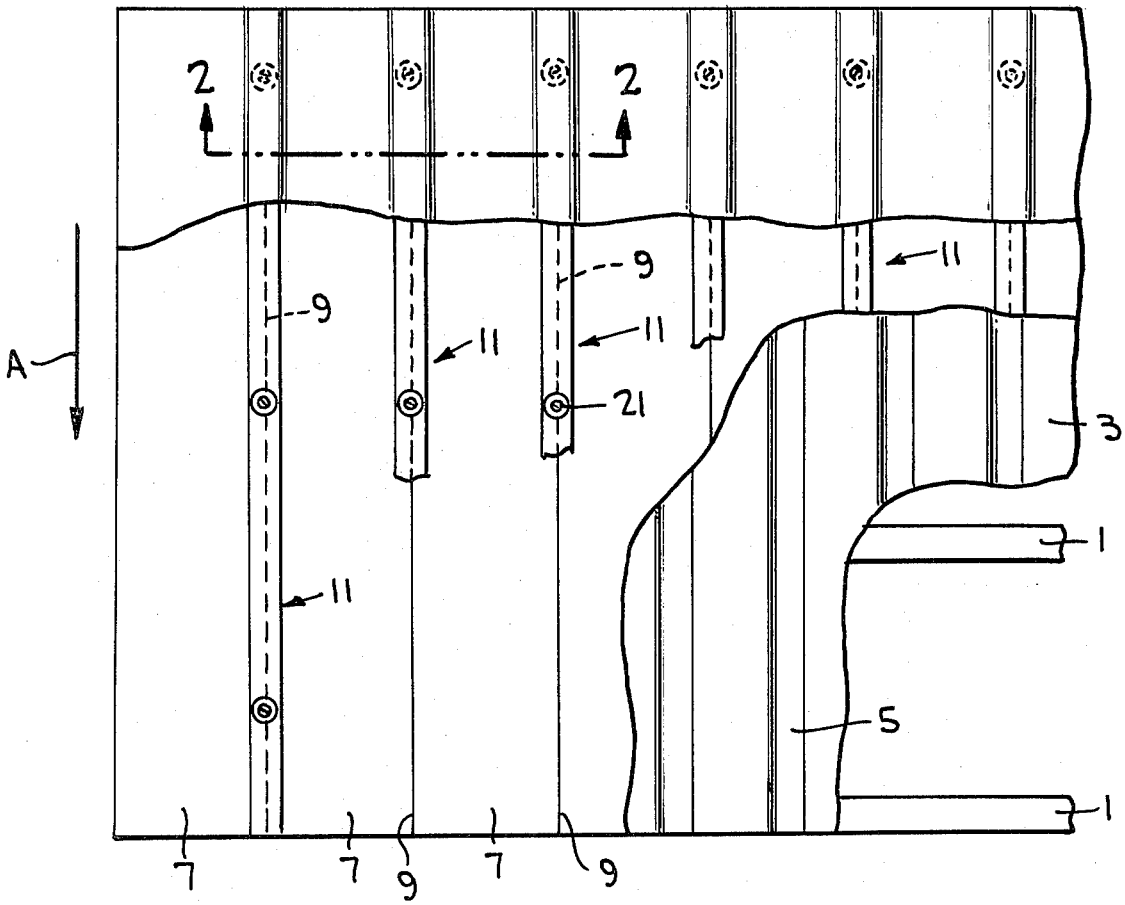
FIG. 1 is a plan view, with parts thereof broken away of a roof embodying this invention.
Figure 2:
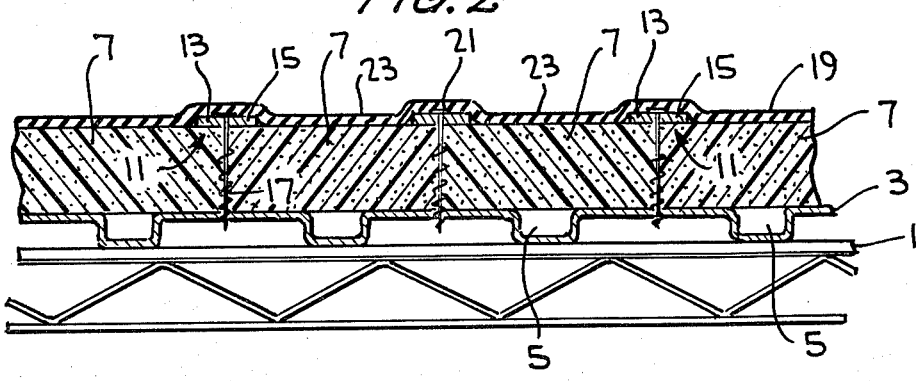
FIG. 2 is a view taken on the line 2—2 of FIG. 1.

In FIG. 1 of the drawings the arrow A indicates the slight inclination to the horizontal which the completed roofing structure will have to provide for the natural flow of water from the roof. A plurality of roof joists 1 are provided in spaced relation and form the basic supporting means for the entire roof. A metal roof decking 3 is mounted on the joist 1 and extends therebetween and is fixed to the joists 1 in any suitable manner. The metal decking may be generally of corrugated construction providing a series of spaced apart depressions 5 therein. In constructing the roof of this invention a plurality of blocks of insulation 7 are loosely laid upon the metal decking 3. Such blocks of insulation are usually at least 4 ft. wide by 4 or 8 ft. long and thus are of oblong configuration. The blocks are loosely laid on the metal decking so that the longitudinal edges thereof are in abutting positions providing a seam 9 between adjacent blocks. A characteristic of this proposal resides in the structural fact that the blocks are laid longitudinally with respect to the slight inclination from the horizontal of the roof so that the seams 9 are parallel to this slight inclination. A wooden or metallic furring strip is utilized and is designated generally by the numeral 11. This furring strip is of a length substantially the same as the lengths of the insulation blocks and is applied over and extends along each seam 9 so that furring strips extend parallel to the slight inclination of the roof to the horizontal and to the natural flow of water from the roof. Each furring strip is of a width to fully cover the seam 9 and to extend on each side thereof as at 13 and 15 over adjacent insulation blocks 7.

A plurality of longitudinally spaced apart screws or the like 17 are provided along each seam 9 and such screws extend through the seam between insulation blocks and are screwed into the metal decking 3 and they also extend through furring strips 11. It will thus be clear that each furring strip by means of these screws or other suitable fastening means is firmly clamped to the adjacent insulation blocks by means of the extending portions 13 and 15, and since each screw extends into the metal decking the entire combination is firmly attached to the metal decking, the insulation blocks being clamped between the furring strips 11 and the metal decking 3.

A rubber or the like membrane 19 covers the insulation blocks, furring strips, the screws 17 and the screw heads 21, and is adhesively secured to each furring strip 11 which is used in the entire roofing structure. It has been my experience that the membrane 19 when only caused to adhere to the furring strips 11 will remain in proper position covering the roof under various types of weather conditions and the like so that it is unnecessary to attempt to use adhesive to secure the portions 23 to the insulation blocks. The portions 23 cover the insulation blocks between the furring strips.

In practicing the method of this invention following construction of the joists and metal decking 3 the insulation blocks 7 are loosely laid on the metal decking whereupon a furring strip 11 is positioned over each seam 9 between adjacent blocks with the portions 13 and 15 thereof extending over an area of adjacent blocks which are adjacent to the seam. Whereupon a plurality of longitudinally spaced apart screws or the like fastening means are screwed through each furring strip 11, through the seam and into the metal deck 3. The entire upper portions of the furring strips are coated with an adhesive and the membrane 19 is then applied over all of the insulation blocks and the furring strips to which it is caused to adhere by means of the adhesive. In certain installations it may be further desirable to apply a coat of adhesive to the under surface of the membrane 19 which will overlay the furring strips 11.

What is claimed is:

1. For use in securing adjacent loosely laid insulation blocks to a roof deck, a roofing structure comprising a roof deck and a plurality of elongated insulation blocks supported on and in direct engagement with the roof deck in directly abutting positions providing a longitudinally extending seam between adjacent insulation blocks, a furring strip covering said longitudinally extending seam in overlying relation thereto and in bridging relation to and in direct contact engagement with said adjacent insulation blocks, the furring strip having a length at least equal to that of the individual elongated insulation blocks, fasteners extending through said furring strip and into the roof deck, the fasteners coacting in cooperation with the furring strip to secure and maintain the strip and underlying insulation blocks in proper position as an integral unit with the adjacent abutting blocks being clamped against the roof deck by the fasteners, a continuous imperforate membrane sheet in direct overlying contact engagement with said furring strip and insulation blocks and providing a covering therefor, and adhesive means bonding the membrane sheet directly to the furring strip, the roof deck being inclined to the horizontal for natural flow of water therefrom and the longitudinally extending seams between adjacent abutting blocks extending parallel to the direction of the roof deck inclination and the natural flow of water.

* * * * *